US005356343A

United States Patent [19]

Lovetere

[11] Patent Number: 5,356,343

[45] Date of Patent: Oct. 18, 1994

[54] FLASH MAGIC WAND

[76] Inventor: Christopher J. Lovetere, 786 Summer St., Brockton, Mass. 02402

[21] Appl. No.: 922,070

[22] Filed: Jul. 29, 1992

[51] Int. Cl.[5] ..... A63H 33/26

[52] U.S. Cl. ..... 472/57; 472/61; 362/102; 446/485

[58] Field of Search ..... 446/484, 485; 472/57, 472/61; 362/102, 202, 32, 806

[56] References Cited

U.S. PATENT DOCUMENTS

| | | | |
|---|---|---|---|
| 1,177,241 | 3/1916 | Gay | 362/102 X |
| 3,707,055 | 12/1972 | Pearce | 446/485 |
| 4,282,681 | 8/1981 | McCaslin | 446/484 |
| 4,891,032 | 1/1990 | Davis | 446/485 X |
| 4,967,321 | 10/1990 | Cimock | 446/485 X |
| 5,036,442 | 7/1991 | Brown | 362/102 |
| 5,165,781 | 11/1992 | Orak | 446/485 X |

*Primary Examiner*—Carl D. Friedman
*Assistant Examiner*—Kevin D. Wilkens

[57] ABSTRACT

A black magician's wand with white tips with a built in flash at one end and a triggering means contained therein. The method of triggering the flash is concealed. In one version of the wand, the flash is triggered by means of a push button switch. In another version of the invention, the flash is triggered by means of a mercury tilt switch within the wand. Manipulation of the wand through a horizontal plane causes the switch to activate the flash.

10 Claims, 2 Drawing Sheets

FLASH MAGIC WAND

BACKGROUND OF THE INVENTION

This invention relates to magic amusement devices, and in particular to a magic wand with illumination means adapted to be flashed on and off by the user.

It is an object of the present invention to provide a wand for use by magicians in which the illumination means is adapted to be flashed by the magician without disclosing the means for flashing nor the illumination means before flashing.

SUMMARY OF THE INVENTION

To attain this, the present invention provides a black wand with white tips with a built in flash at one end and a triggering means contained therein.

This together with other objects of the invention, along with various features of novelty that characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
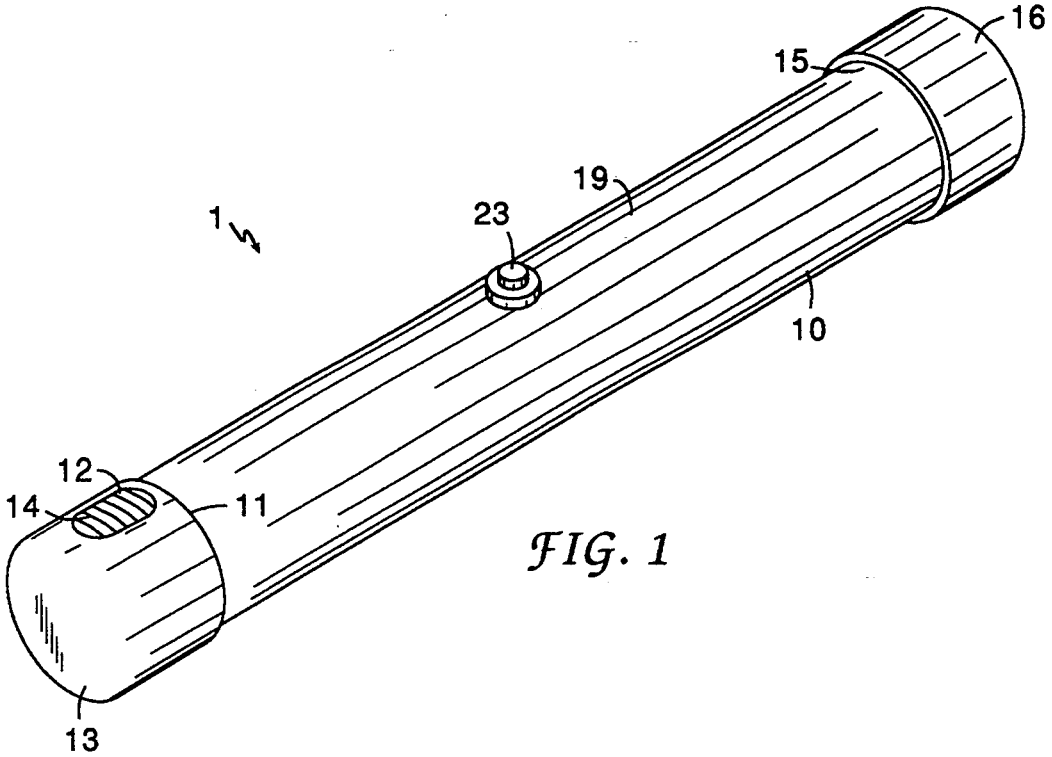
FIG. 1 is a perspective view of a first embodiment of a flash magic wand constructed according to the principles of the present invention.
Figure 2:
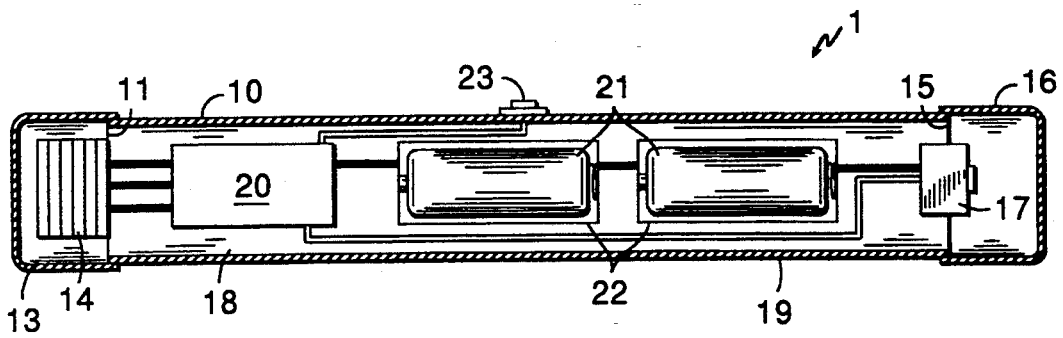
FIG. 2 is a side elevational view, partly in section, thereof.

Referring to the drawings in detail wherein like elements are indicated by like numerals, there is shown in FIGS. 1 and 2 a first embodiment of a magic wand 1 constructed according to the principles of the invention. This embodiment of the invention is intended for the stage magician who is usually at some distance from the audience. The wand 1 has a generally elongated, hollow, cylindrical shaped body 10. The body 10 has a black color and is approximately fourteen inches long. The body 10 has two ends 11, 15, one of which is designated the light end 11 and the other of which is designated the switch end 15. The light end 11 terminates in an end cap 13 having a strobe light 14 contained therein. A portion of the end cap 13 is cut away thereby forming a small window opening 12 externally exposing the strobe light 14. The switch end 15 terminates in an end cap 16 containing a small, manually activated, slide, on/off power switch 17. This switch 17 is designated as the power switch. The switch 17 is concealed by the end cap 16. It is turned on prior to a magician's show and remains on during the performance.

The strobe light 14 is electrically connected to a conventional flash circuit 20 positioned within the wand body 10 near to the light end 11. The flash circuit 20 is electrically connected through the power switch 17 to a power source 21. In this embodiment of the invention, the power source 21 is comprised of two alkaline AA batteries. The batteries 21 are positioned within the wand body 10 on battery holders 22 that provide spring tension for holding each battery 21 and which are shaped to snugly fit into the internal cavity 18 of the wand 10. A second switch 23 is electrically added to the flash circuit 20. The second switch 23 electrically connects the strobe light 14 to the flash circuit 20 and is physically extended through the wand body 10 from the wand interior 18 to the wand's exterior surface 19. The second switch 23 is a push button type switch designated as a trigger switch and activates the strobe light 14 from the flash circuit 20 when pressed. When held at a proper angle, the strobe window 12 and trigger switch 23 are hidden from the audience's view. It is, therefore, difficult for an audience to determine how the magician is causing the wand 1 to flash.

Figure 3:
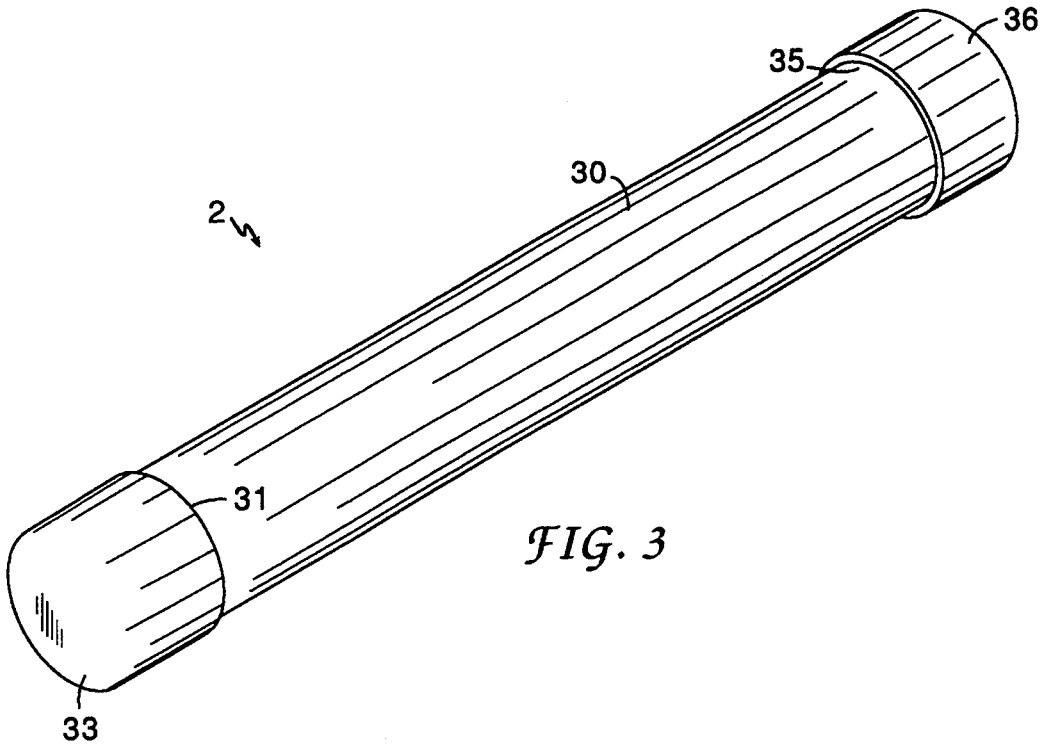
FIG. 3 is a perspective view of a second embodiment of the invention.
Figure 4:
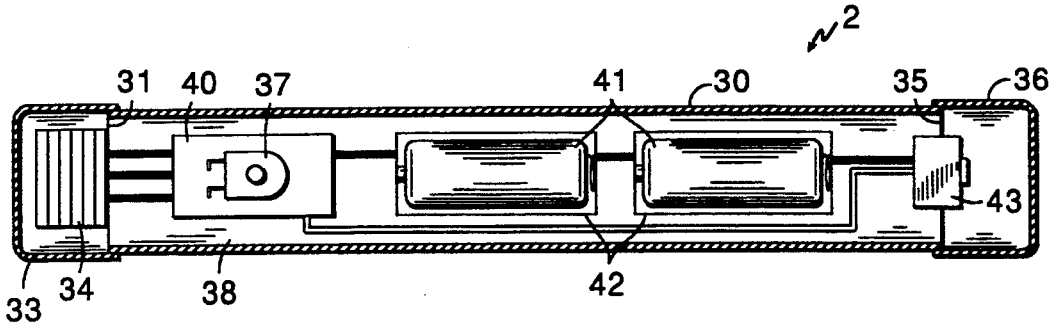
FIG. 4 is a side elevational view, partly in section, thereof.

In a second embodiment of the invention shown in FIGS. 3 and 4 a second embodiment of a magic wand 2 is illustrated. This embodiment of the invention is intended for the close-up magician who is under more intense scrutiny than the stage magician. The wand 2 has a generally elongated, hollow, cylindrical shaped body 30. The body 30 has a black color and is approximately ten inches long which satisfies the out of pocket style of many close-up magicians. The body 30 has two ends 31, 35, one of which is designated the light end 31 and the other of which is designated the switch end 35. The light end 31 terminates in an end cap 33 having a strobe light 34 contained therein. The end cap 33 completely conceals the strobe light 34. Although the end cap 33 is generally opaque, it is made out of a thin material which permits transmission of a substantial portion of the light from the strobe light 34. The switch end 35 terminates in an end cap 36 containing a small, manually activated, slide switch, on/off power switch 43. This switch 43 is designated as the power switch.

The strobe light 34 is electrically connected to a conventional flash circuit 40 positioned within the wand body 10 near to the light end 31. A mercury tilt switch 37 electrically connects the flash circuit 40 to the strobe light 34. The tilt switch 37 is the trigger switch. The switch 37 is designed to be open when the wand body 30 is positioned vertically and to be closed when the wand body 30 is positioned horizontally. In this embodiment of the invention, the power source 41 is comprised of two alkaline AA batteries. The batteries 41 are positioned within the wand body 30 on battery holders 42 which provide spring tension for holding each battery 41 and which are shaped to snugly fit into the internal cavity 38 of the wand body 30. The power switch 43 and is turned on at the start of a magician's performance and left on during the show. The mercury tilt switch 37 actually triggers the strobe light 34 contained within the end cap 33 when the wand 2 is tipped past horizontal. The strobe light 34, power switch 43, and trigger switch 37 are completely hidden from view. It is, therefore, difficult for a close-in observer to determine how the strobe light is activated.

In operation the wand 2 may be manipulated is several different ways to trigger the strobe light 34. Tipping the wand body 30 past horizontal will cause the mercury tilt switch 37 to close, thereby electrically connecting the strobe light 34 to the flash circuit 40 causing the strobe light 34 to flash. A sharp flick of the magician's wrist will propel the mercury within the trigger switch 37 upwards thereby causing the switch 37 to close and triggering a flash from the strobe light 34. The wand 2 may also be made to flash when not in the magician's hands by tossing the wand 2 straight up in such a way that at the peak of the toss the wand 2 begins to tumble. As the tumbling wand 2 passes through the horizontal plane a flash is triggered. The magician may hand the wand 2 to a spectator and have the spectator trigger a flash without knowing how. By simply having the spectator waive the magic wand 2, the spectator will cause the mercury tilt switch 37 to trigger a flash from the strobe light 34.

OPERATION

A magic wand 1 or 2, having a black body 10 or 30 with white end caps 13, 16 or 33, 36, is disclosed for use by magicians to give the appearance that the wand 1, 2 has magic powers. The method of triggering the flash is concealed in both versions of the invention.

In the stage version of the wand 1, the wand 1 is held with the push button trigger switch 23 and the strobe window 12 facing the magician, thereby giving the magic wand 1 the appearance of an ordinary wand. When the magician gestures, he conceals the button 23 with his thumb and pressing it as he exposes the window 12 to the audience. The flash is generated by the strobe light 14 and the wand 1 is brought back to a position which conceals the window 12 and switch button 23.

In the close-up version of the wand 2, the effect is similar. A bright blast of white light comes from the end of the wand 2 at the will of the magician. The difference is that this version of the wand 2 can be handed to a spectator without the spectator discovering either the source of the light or the means by which it is triggered. This is accomplished by means of a mercury tilt switch 37 mounted on the flash circuit 40 concealed within the wand body 30. The strobe light 34 is completely concealed by an end cap 33. Yet the flash of light is intense enough to penetrate the end cap 33.

It is understood that the above-described embodiment is merely illustrative of the application. Other embodiments may be readily devised by those skilled in the art which will embody the principles of the invention and fall within the spirit and scope thereof.

I claim:

1. A flash magic wand, comprising:

a generally elongated, hollow, cylindrical shaped body, having two ends, one of which is designated the light end and the other of which is designated the switch end, said light end terminating in an end cap, and said switch end terminating in an end cap;

a strobe light positioned within said light end and concealed by said end cap;

a power source contained within said wand body;

a flash circuit electrically connected to said strobe light and positioned within the wand body near to the light end, said flash circuit being electrically connected to said power source;

a power switch interconnecting said flash circuit with said power source; and a trigger switch electrically interconnecting said flash circuit and said strobe light for causing activation of said strobe light from said flash circuit.

2. A flash magic wand in accordance with claim 1, wherein:

a portion of the light end end cap is cut away thereby forming a small window opening externally exposing the strobe light.

3. A flash magic wand in accordance with claim 2, wherein:

said power switch is positioned within said switch end and concealed by said end cap.

4. A flash magic wand in accordance with claim 3, wherein:

said trigger switch in a normally open position is physically extended through the wand body from the wand interior to the wand's exterior surface.

5. A flash magic wand in accordance with claim 4, wherein:

said power source is comprised of a plurality of cylindrical batteries positioned within the wand body on battery holders that provide spring tension for holding each battery, said battery holders being shaped to snugly fit into the internal cavity of the wand.

6. A flash magic wand in accordance with claim 5, wherein:

said trigger switch is a small, manually activated, push button, on/off power switch.

7. A flash magic wand in accordance with claim 1, wherein:

said power switch is a small, manually activated slide switch positioned within said switch end end cap.

8. A flash magic wand in accordance with claim 7, wherein:

said trigger switch is comprised of a mercury tilt switch positioned within said wand body.

9. A flash magic wand in accordance with claim 8, wherein:

said trigger switch is open when the wand body is positioned vertically and closed when the wand body is positioned horizontally.

10. A flash magic wand in accordance with claim 9, wherein:

said power source is comprised of a plurality of cylindrical batteries positioned within the wand body on battery holders that provide spring tension for holding each battery, said battery holders being shaped to snugly fit into the internal cavity of the wand.

* * * * *